United States Patent [19]

Carnahan et al.

[11] Patent Number: 5,044,023

[45] **Date of Patent: * Sep. 3, 1991**

[54] INTEGRATED MATTRESS AND COMMODE WITH SEGMENTED MATTRESS/COMMODE SECTION

[76] Inventors: Monte Carnahan; Gayle A. Carnahan, both of 100 W. Cedar, Wilburton, Okla. 74578

[ * ] Notice: The portion of the term of this patent subsequent to Jul. 31, 2007 has been disclaimed.

[21] Appl. No.: 468,853

[22] Filed: Jan. 23, 1990

Related U.S. Application Data

[63] Continuation-in-part of Ser. No. 439,849, Nov. 20, 1989, Pat. No. 4,944,058.

[51] Int. Cl.[5] ..... A61G 7/02

[52] U.S. Cl. ..... 5/90; 4/254; 4/480; 5/463

[58] Field of Search ..... 5/463, 90, 60; 4/239, 4/237, 235, 452, DIG. 18, 254, 480; 128/853, 850

[56] References Cited

U.S. PATENT DOCUMENTS

| | | | |
|---|---|---|---|
| 169,705 | 11/1875 | Huntress | 5/90 |
| 793,061 | 6/1905 | Dugan | 4/480 |
| 876,238 | 1/1908 | Rode | 5/90 |
| 2,500,739 | 3/1950 | Beem | 5/90 |
| 2,500,743 | 3/1950 | Beem et al. | 5/90 |
| 3,050,741 | 8/1962 | Coleman | 5/90 |
| 3,959,833 | 6/1976 | Burke | 5/463 |
| 4,334,330 | 6/1982 | Marshall | 5/90 |

*Primary Examiner*—Alexander Grosz

*Attorney, Agent, or Firm*—Ross, Howison, Clapp & Korn

[57] ABSTRACT

A bed with an integrated commode includes a mattress (70) and a secondary support surface (72). The secondary surface (72) has a hole (26) disposed therein. The hole (26) is operable to receive the outer peripheral edge of the commode seat (14). A sanitary insert (12) is provided which has an upper surface (24) that is disposed over the mattress (10) or moisture-proof mattress cover and attached thereto by a VELCRO Hook and Loop Material attachment device (28). The sanitary insert (12) extends downward into the interior of the bowl with a downward extending portion (30). A commode seat (14) is operable to be disposed on the upper surface of the rim (22) and hold the sanitary insert (12) therein. The seat (14) has a splash guard (16) that extends from the interior surface thereof downward into the bowl. The secondary surface (72) has a portion (74) and a portion (76) that are disposed on opposite sides of the hole (26). The portions (74) and (76) have an upper surface associated therewith to provide support on either side of the hole (21). A bridging portion (78) is disposed therebetween with one edge of portions (74) and (76) forming an edge (80) that is operable to abut up against one side of the mattress (70).

3 Claims, 5 Drawing Sheets

FIG. 2
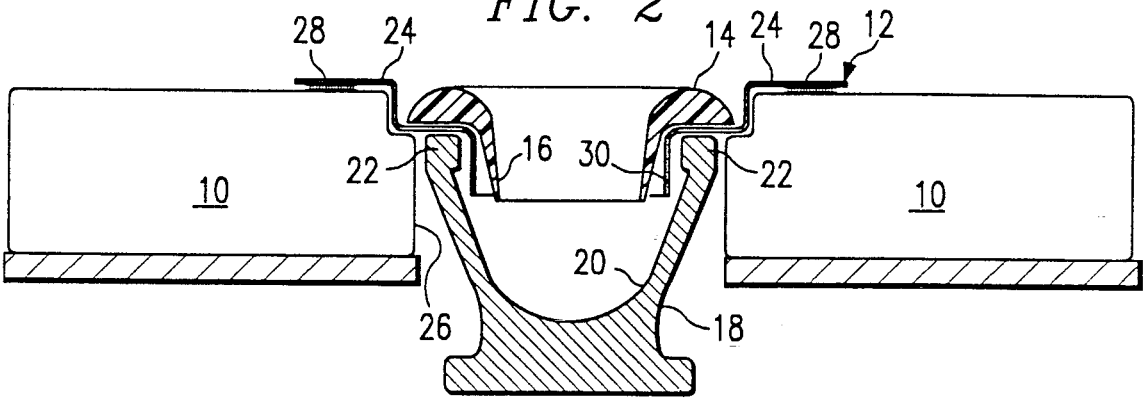
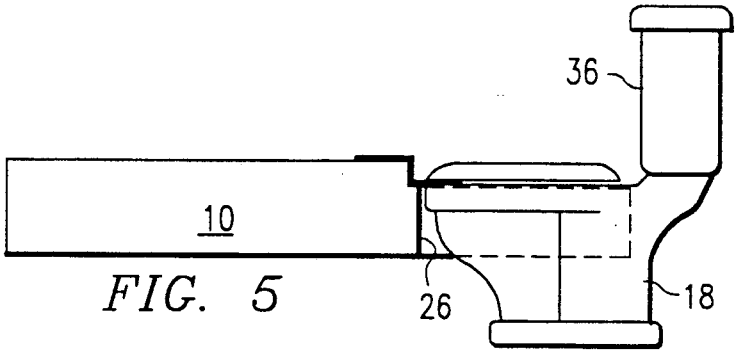
FIG. 5
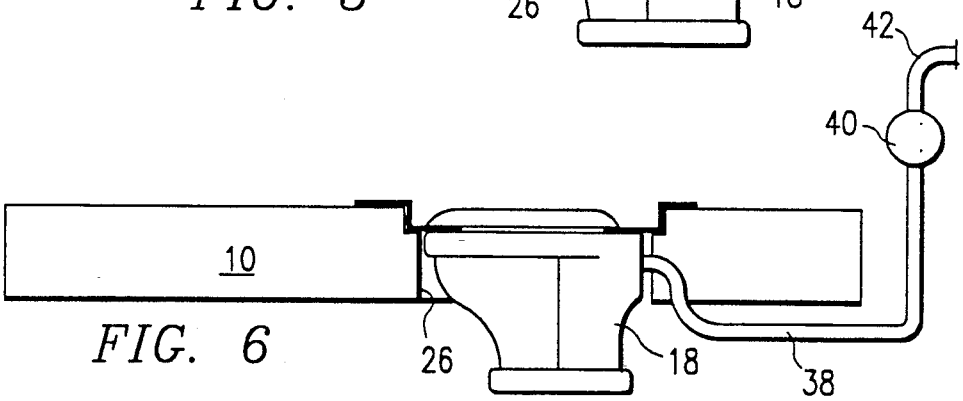
FIG. 6
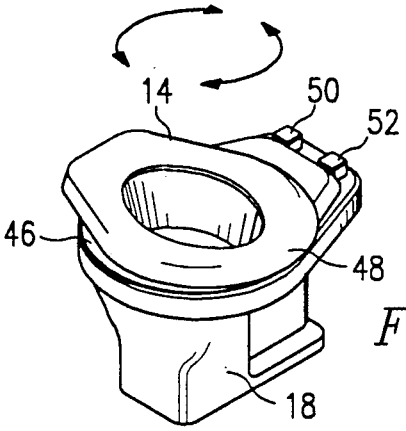
FIG. 7

INTEGRATED MATTRESS AND COMMODE WITH SEGMENTED MATTRESS/COMMODE SECTION

CROSS REFERENCE TO RELATED APPLICATIONS

This application is a continuation in part of U.S. patent application Ser. No. 439,849, filed Nov. 20, 1989 and entitled "Integrated Mattress and Commode" now U.S. Pat. No. 4,944,058.

TECHNICAL FIELD OF THE INVENTION

The present invention pertains in general to a combination of a mattress bed frame and a commode insert, and more particularly, to the interface between the commode and the mattress, and to the swiveling mechanism of the commode seat.

BACKGROUND OF THE INVENTION

Traditional devices such as bedpans are often used for patients or elderly individuals in nursing homes and elderly or other individuals confined to bed at home or individuals having balance problems thus subject to falling and necessitating the need for someone to be with them. However, these devices usually require the dependency of the patient or elderly individual on the nursing staff of an institution, or on care providers at home. Other conventional devices known in the art require that the patients be displaced relative to their beds, or leave their beds, in order to enable them to use the toilet in a seated, normal upright position.

Devices that have integrated a commode with the actual bed itself have been overly complicated. For example, in U.S. Pat. No. 3,959,833, issued to Burke et al., an insert is provided whereby a portion of the mattress is removed and a portable commode is inserted therefore. However, the individual is required to assist in positioning this commode in the bed. This type of system does not facilitate connection to plumbing sanitary waste of domestic water lines and still requires some other type of intervention by the nursing staff, or care provider.

SUMMARY OF THE INVENTION

The present invention disclosing claims herein comprises a mattress and bed frame that form a primary sleeping surface that is parallel with the floor in which the mattress and bed frame are disposed. A secondary support surface and associated support are provided having a hole disposed therethrough. The hole is operable to receive the upper portion of a commode such that the upper surface of the commode seat is proximate to the same plane as the upper surface of the secondary support surface. The hole is approximately the same size as the outer peripheral edge of the commode seat. The secondary support surface has first and second support portions disposed on either side of the commode and a bridging portion disposed in the front of the commode. The bridging portion in the first and second portions provide an abutting surface that is operable to abut against one side of the mattress. A securing device is provided for securing the two surfaces together.

BRIEF DESCRIPTION OF THE DRAWINGS

For a more complete understanding of the present invention and the advantages thereof, reference is now made to the following description taken in conjunction with the accompanying Drawings in which:

FIG. 2 illustrates a cross-sectional diagram of the commode and mattress;

FIG. 5 illustrates a cross-sectional side view of an embodiment utilizing a tank type commode;

FIG. 6 illustrates a side cut-away view of an embodiment utilizing a flush valve;

FIG. 7 illustrates a detail of the swivel operation of the commode seat for use with the tank-type and/or flush valve system in the supine position;

DETAILED DESCRIPTION OF THE INVENTION

Figure 1:
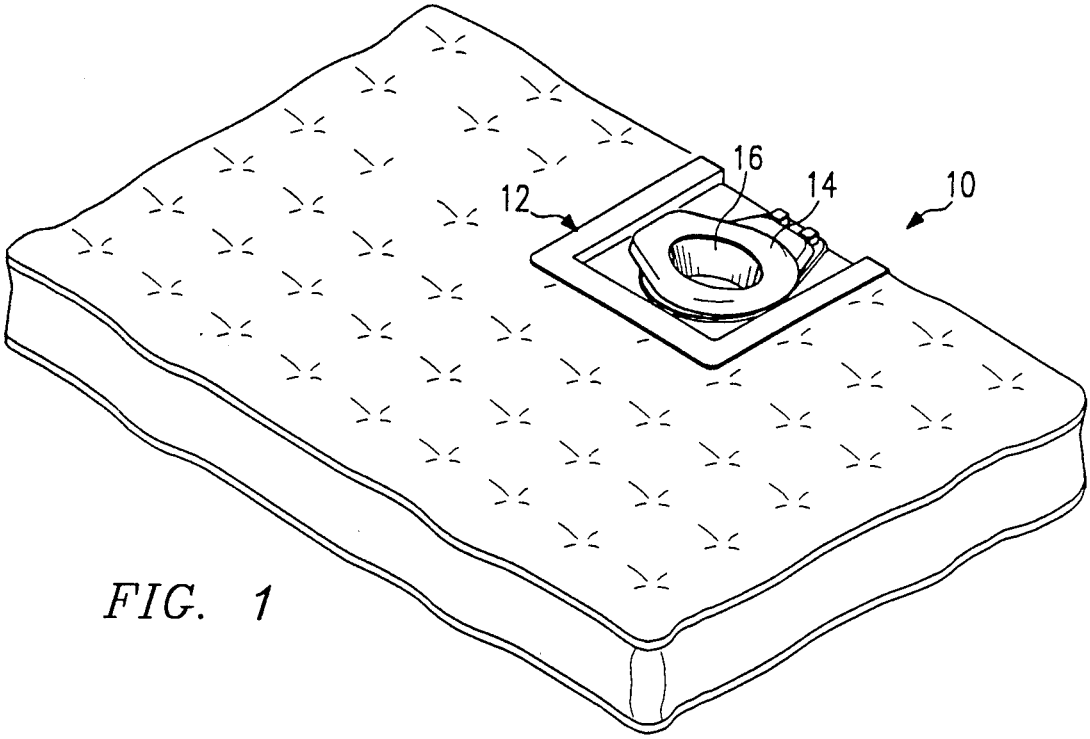
FIG. 1 illustrates a perspective view of the integrated commode and mattress.

Referring now to FIG. 1, there is illustrated a perspective view of the mattress 10 in which a commode is inserted. The commode is hidden by the mattress and is not shown in FIG. 1. A sanitary insert 12 is provided which is operable to be disposed over an opening (not shown) in the mattress 10. The sanitary insert has a flat portion that is operable to be disposed on the surface of the mattress 10 or moisture-proof mattress cover adjacent the periphery of the opening in the mattress 10. The sanitary insert 12 also has a vertical portion that is operable to be disposed downward into the opening to provide a seal and extend into the opening of the commode. A commode seat 14 is provided which is operable to be disposed over the sanitary insert, the commode seat 14 having a splash guard 16 extending downward from the interior rim thereof into the commode.

Referring now to FIG. 2, there is illustrated a cross-sectional diagram of the mattress 10 and a commode 18. The commode 18 has an interior 20 and an upper rim 22. The upper surface of the mattress 10 or moisture-proof mattress cover is approximately one inch higher than the upper surface of the commode seat 14. In this manner, the weight of an individual on the mattress 10 proximate to the commode seat 14 results in compression of the mattress 10 to approximately the level of the commode seat 14, thus enabling the individual to easily move from the mattress 10 to the commode seat 14.

The sanitary insert 12 has an upper flat surface 24 extending from an opening 26 in the mattress 10 away from the edge thereof. The flat surface 24 is attached to the mattress 10 or moisture-proof mattress cover by a Velcro-type attachment 28 around the peripheral edges of the flat surface 24. The sanitary insert 12 has a vertical portion 30 that extends downward into the commode and over the upper lip 22. The sanitary device 12 is a water repellent material such that any fluids and the such that fall on the upper surface of the sanitary device 12 will fall downward into the interior 20 of the commode 18 and will not go between the commode 18 and the mattress 10 through the opening 26. This provides an increased moisture barrier.

The commode seat 14 is operable to be disposed over the sanitary device 12 and in adjacent contact with the lip 22 such that it holds sanitary device 12 in secure contact with the upper lip 22 of the commode 18. The splash guard 16 is typically fabricated of a hard plastic material which can be cleaned and extends downward essentially the same distance as the vertical portion 30 of the sanitary insert 12. The sanitary insert 12 is, in the preferred embodiment, an acetate tricot laminated to a vinyl back. This is designed to be a disposable or washable material that can be removed and disposed of or washed whenever it becomes soiled. A new or clean insert can then be disposed over the opening between the seat 14 and the upper lip 22.

Figure 3:
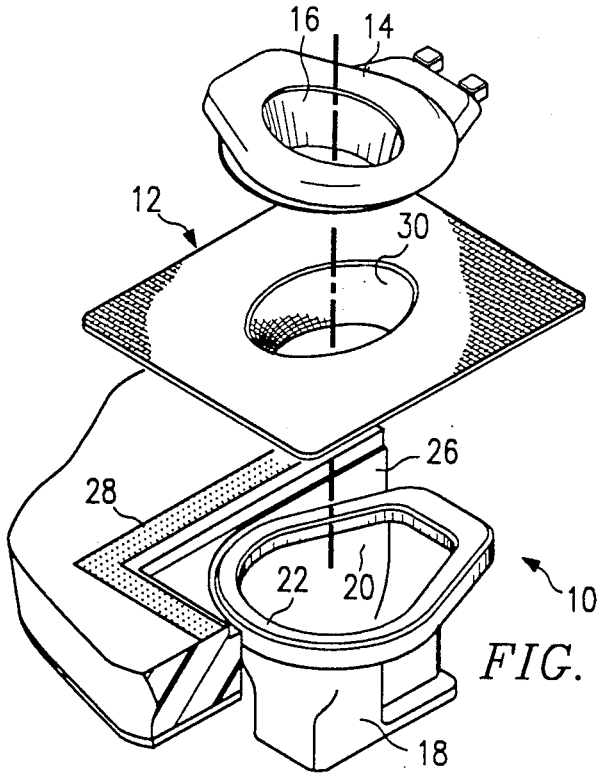
FIG. 3 illustrates a blow-up view of the sanitary insert, the commode seat and the commode, with a cut-away view of the mattress.

Referring now to FIG. 3, there is illustrated a blow-up of the commode seat 14, the sanitary insert 12 and the commode 18 with a cut-away of the bed 10. It can be seen that the Velcro strips 28 are formed on the surface of the bed 10 or moisture-proof mattress cover and the sanitary insert 12 is first disposed down over the opening 26 and the interior 20 of the commode 18, thus providing a waterproof seal over the lip 22 of the commode 18. The Velcro strips 28 are then attached to prevent the movement of the sanitary insert 12 and then the commode seat 14 disposed through the opening in the sanitary insert 12 such that the splash guard 16 is disposed adjacent the portion 30 of the sanitary insert 12 and completely surrounded thereby. Similarly, the sanitary insert 12 can be removed by reversing this process.

Figure 4:
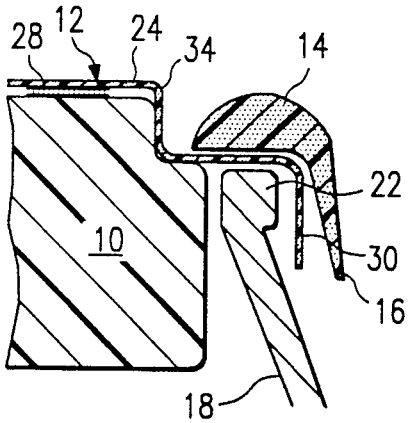
FIG. 4 illustrates a detail of the sanitary seal provided by the sanitary device and the commode seat.

Referring now to FIG. 4, there is illustrated a detailed view of the installation of the sanitary insert 12 illustrating in detail one of the upper lips 22 of the commode 18 and the seal formed by the sanitary insert 12 between the commode lid 14 and the upper lip 22. The sanitary insert 12 can either be formed from a single molded piece of material or, more preferably, it is formed from two portions, flat portion 24 and downwardly extended portion 30, sewn together at a point 34. As described above, this is a disposable or washable insert and may be changed or washed, respectively, only when needed. The splash guard 16 prevents excessive soiling of the downwardly extended portion 30, thus reducing the need for changing or washing on a frequent basis.

Referring now to FIG. 5, there is illustrated one embodiment of the installation of the commode 18 and the mattress 10. A tank-type commode can be utilized which has a supply tank 36 disposed on the back thereof. With this type of system, the commode must be disposed adjacent the edge of the bed such that a tank can protrude upward therefrom. Therefore, the opening 26 would be disposed at one edge of the mattress 10.

Referring now to FIG. 6, in an embodiment of the present invention, the commode 18 operates on a flush valve. Therefore, the commode 18 can be disposed in any location within the periphery of the mattress 10 and a water line 38 routed over to a flush valve 40 which goes to a water supply through a pipe 42. The flush valve 40 allows sufficient pressure to be routed to the commode 18 to provide the flushing action. However, the commode 18 should still be disposed adjacent the edge of the bed to allow adequate sleeping space capability, and to enable the patient to use toilet in a seated upright position. Additionally, the flush valve 40 must be located in an easily accessible location. Alternatively, the flush valve 40 could be replaced by a water closet (not shown) that would be disposed at a height sufficient to generate enough pressure for the flushing operation.

Referring now to FIG. 7, there is illustrated a swiveling mechanism for the commode seat 14. Typically, the commode 18 must be oriented to accommodate the water lines, the soil pipe, etc. However, commode seats are "polarized" to provide a proper anatomical accommodation. Most commode seats are configured for an upright sitting position whereas the present invention is utilized in a supine position to accommodate a more comfortable position for those individuals unable to sit in an upright position. The commode seat 14 preferably is foam padded. As such, the commode seat may not be oriented in the right direction and, therefore, the swiveling seat of FIG. 7 is provided. The seat 14 is comprised of a bottom portion 46 and an upper portion 48. The bottom portion 46 has two hinged brackets 50 and 52 which are normally found on a commode seat. These interface with the commode itself in a conventional manner. The upper portion 48 swivels about the bottom portion 46. In the preferred embodiment, this utilizes a slot-and-eye bolt with the eye-bolt being driven from the other side of the upper portion 48 and the slot being positioned in the lower portion 46. Alternatively, variously pre-drilled holes can be provided for the downwardly directed bolt (not shown), such that the seat can be positioned in a number of predetermined orientations. The primary object of the seat of FIG. 7 is to provide different orientations which can be provided by either a pivoting/locking mechanism or by pre-drilled holes.

Figure 8:
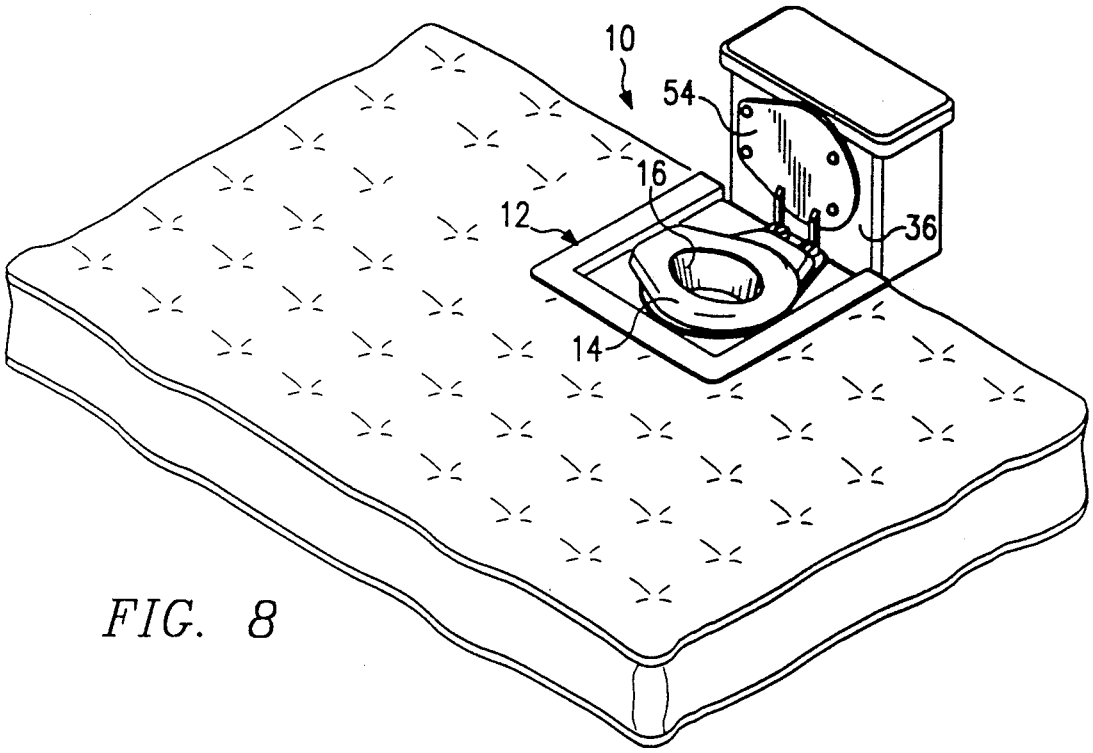
FIG. 8 illustrates an embodiment for utilization with a cover.

Referring now to FIG. 8, there is illustrated an embodiment of the closed seat of FIG. 1. In the embodiment of FIG. 8, a cover 54 is provided which is operable to be raised and lowered relative to the tank 36 and cover the seat 14. In this manner, the opening in the commode can be covered.

Figure 9:
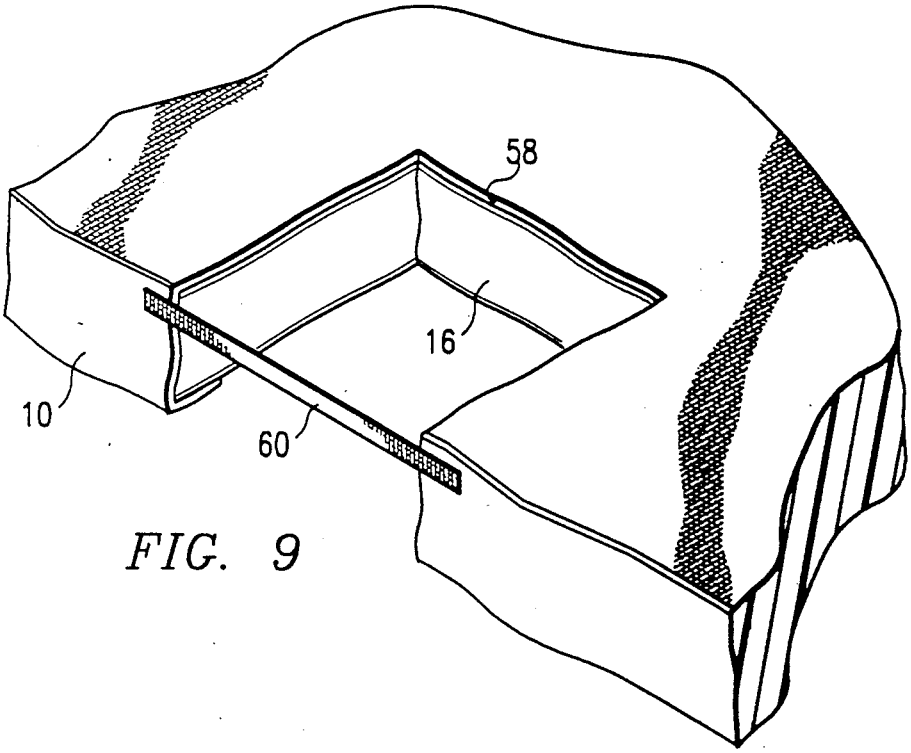
FIG. 9 illustrates the attachment of the mattress cover in the slot formed in the mattress.

Referring now to FIG. 9, there is illustrated a detail of the slot formed in the mattress 10. A mattress cover 58 is provided which is sized to allow the slot to be opened. The slot is formed on the edge of the mattress 10 and on the open end of the slot, there is provided a restraining strap 60, the restraining strap 60 attaches to the mattress cover on either side of the opening in the edge of the mattress 10. This allows the tank type or flush valve commode to be disposed therein and retain the original shape of the mattress cover 58.

Figure 10:
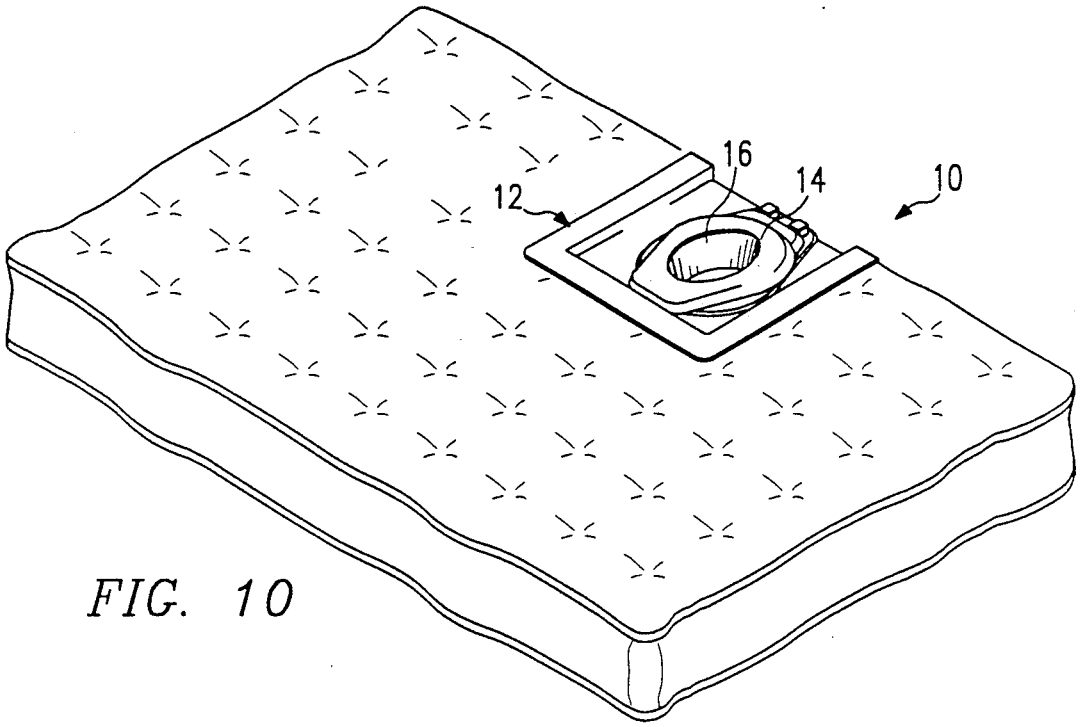
FIG. 10 illustrates an embodiment wherein the commode seat is disposed on the edge of the mattress and oriented such that it facilitates use in the seated normal upright position.

Referring now to FIG. 10, there is illustrated an alternate embodiment. The commode seat 14 is illustrated as being disposed at a 180° angle with respect to the normal orientation. This facilitates use with the legs draped over the side of the bed and in a seated upright position. The flush valve commode 18 of FIG. 6 would be preferred for this embodiment, which would be disposed adjacent the edge of the bed. However, the tank type commode can still be used effectively in the event water pressure is not adequate to use the flush valve commode.

Figure 11:
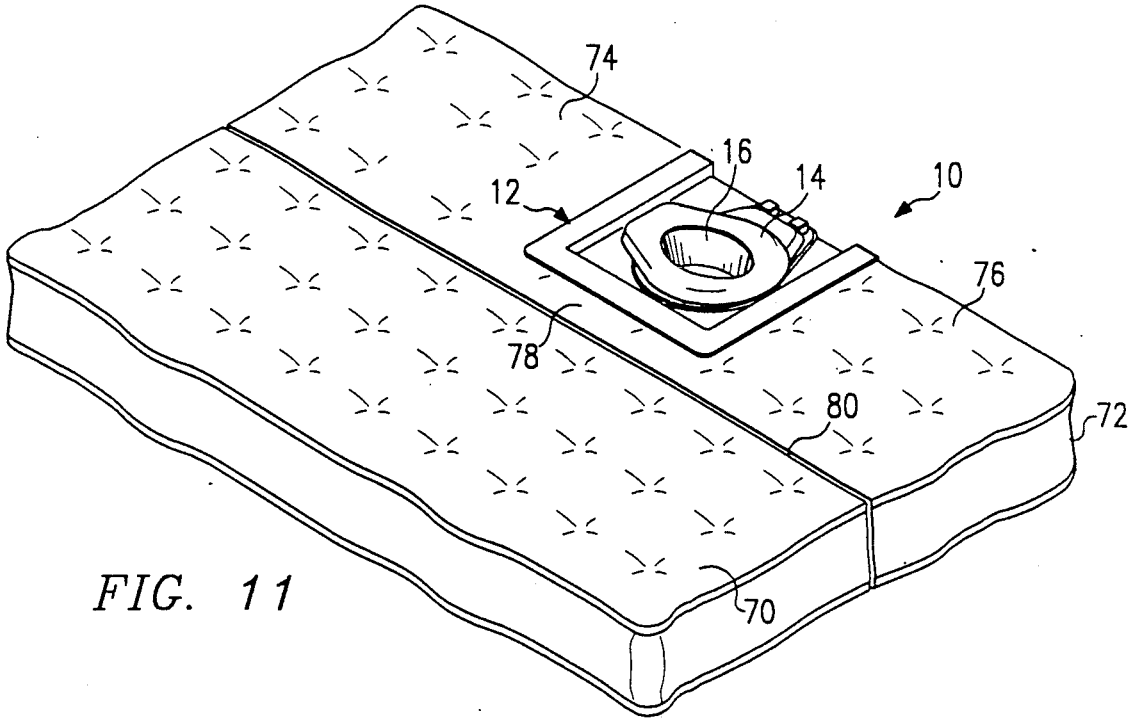
FIG. 11 illustrates the preferred embodiment of the present invention in a perspective view.

Referring now to FIG. 11, there is illustrated a perspective view of the preferred embodiment of the present invention. A mattress 70 is provided which is a conventional mattress. The commode 18 is disposed with the insert 12 in a separate and smaller mattress portion 72. Mattress portion 72 is comprised of a surface 74 and a surface 76 disposed on either side of the commode 18. The surfaces 74 and 76 are bridged together by portion 78 that is disposed in front of the commode 18. The combination of the surface 74 and surface 76 and the bridging portion 78 form an edge 80 that mates with one edge of the mattress 70. The surface 74 and the surface 76 and the upper surface of the bridging portion 78 are in the same plane with upper surface of the mattress 70. Therefore, when mattress 70 is abutted with the edge 80, an individual can easily move from the sleeping surface on mattress 70 to the upper surface of the commode 18. With the use of the mattress portion 72, a standard sleeping surface on mattress 70 can be utilized while the combination of mattress portion 72 and mattress 70 results in an integrated mattress and commode. Further, the surfaces 74 and 76 are made merely for support and not for the purpose of sleeping, whereas the upper surface of the mattress 70 provides the primary sleeping surface.

Figure 12:
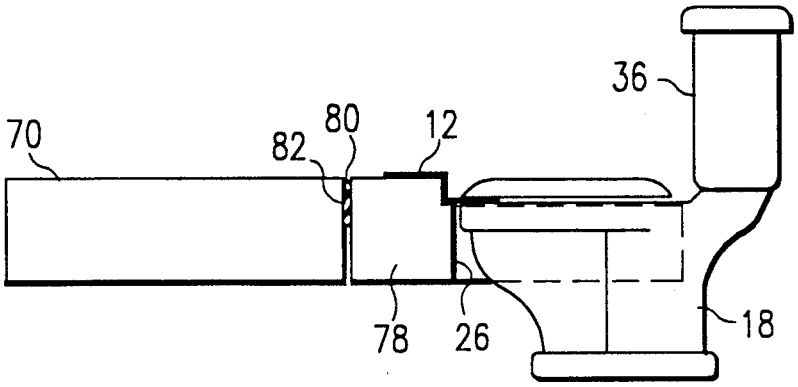
FIG. 12 illustrates a cross-sectional view of the preferred embodiment of FIG. 11 illustrating the mating of the two portions.

Referring now to FIG. 12, there is illustrated a cross-sectional diagram of the embodiment of FIG. 11 taken through the commode 18 and illustrating the junction between the edge 80 of the bridging portion 78 and the abutting portion of mattress 70.

Figure 13:
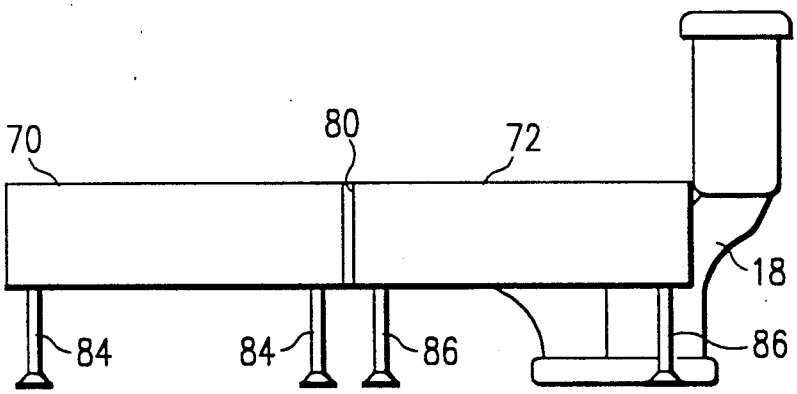
FIG. 13 illustrates a cross-sectional view of the mattress portion adjacent to the commode.

Referring now to FIG. 13, there is illustrated a side view of the mattress 70 and the mattress portion 72. The mattress 70 has supporting legs 84 associated therewith which defines the height of the upper surface of the mattress 70 over the floor. Since it is desirable that the upper surface of the mattress portion 72 be at the same height as the mattress 70, adjustable legs 86 are provided. The adjustable legs 86 are generally comprised of two portions, a secured portion on the bottom surface of the mattress portion 72 and a telescoping portion that extends outward therefrom and down to the floor. In this manner, the mattress portion 72 can be adjusted in height. A securing device 82 is provided that is disposed between the one of the legs 86 and the one of the legs 84 disposed proximate to the edge 80. Securing device 82 holds the mattress portion 72 and the mattress 70 together.

In summary, there has been provided an integrated bed and commode with a sanitary insert. The bed is comprised of a primary sleeping surface and a secondary support surface that is disposed adjacent to the primary sleeping surface. The secondary support surface is provided with a hole therein and the commode disposed within the hole. An insert is provided which extends over the surface of the secondary sleeping surface and down into the commode to provide a waterproof seal at the peripheral edges thereof. A commode seat is provided with a splash guard that extends downward from the interior rim thereof. The commode seat is disposed over the sanitary insert. The sanitary insert is disposable or washable upon spoilage thereof.

Although the preferred embodiment has been described in detail, it should be understood that various changes, substitutions and alterations can be made therein without departing from the spirit and scope of the invention as defined by the appended claims.

What is claimed is:

1. A bed with an integrated commode, comprising:

a mattress and bed frame that comprise a primary sleeping surface, the primary sleeping surface being parallel with the floor on which said mattress and bed frame are disposed;

a flush commode having a commode bowl with a seat thereon;

a secondary support surface and associated support, said secondary support surface having a hole disposed therethrough to receive said commode such that the upper surface of said commode seat is proximate to the same plane as the upper surface of said secondary support surface, the hole approximately the same size as the outer peripheral edge of said commode, said secondary support surface having first and second support portions disposed on either of said commode and a bridging portion disposed in the front of said commode such that one side of said first and second portions and one side of said bridging portion provide an abutting surface that is operable to abut against one side of said mattress;

a sanitary insert for being disposed about the upper lip of the bowl of said commode, said sanitary insert having:

a flat surface for being disposed on the surface of said secondary support surface and about the hole therein and extending from points distal to the rim of the commode bowl to the interior of the rear edge of the commode bowl, a downwardly extending surface being cylindrical in shape and extending from the interior edge of the rim of the commode bowl and downward into the bowl on the interior surface thereof, and means for attaching said flat surface to the surface of said secondary sleeping surface on the outer peripheral edges of the flat surface;

said commode seat configured to fit over and proximate to the rim of the commode bowl and overlying the portion of said sanitary insert disposed over and proximate to the rim of the commode bowl;

a splash guard configured as a cylindrical shaped semi-rigid surface having the peripheral edges on one end thereof attached to the inner peripheral edge of said commode seat, the surface of said splash guard extending downward into said commode bowl; and securing means for securing said secondary support surface to said mattress and bed frame.

2. The apparatus of claim 1 and further comprising means for adjusting the height of said secondary support surface relative to said mattress.

3. The apparatus of claim 1 wherein said commode seat is comprised of an upper portion being capable of reorientation relative to said commode bowl at a different angle thereto.

* * * * *